US007021254B2

(12) United States Patent
Shiraishi et al.

(10) Patent No.: US 7,021,254 B2
(45) Date of Patent: Apr. 4, 2006

(54) ENGINE WITH VARIABLY ADJUSTABLE COMPRESSION RATIO, AND METHODS OF USING SAME

(75) Inventors: Koji Shiraishi, Saitama (JP); Junya Watanabe, Saitama (JP); Ranju Imao, Saitama (JP); Takashi Tsutsumizaki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/886,268

(22) Filed: Jul. 7, 2004

(65) Prior Publication Data

US 2005/0028762 A1 Feb. 10, 2005

(30) Foreign Application Priority Data

Jul. 8, 2003 (JP) ..... 2003-193803

(51) Int. Cl.
*F02B 75/04* (2006.01)

(52) U.S. Cl. ..... 123/78 E

(58) Field of Classification Search ..... 123/78 E, 123/48 B, 48 R, 78 BA, 78 R, 78 F, 197.1, 123/197.4
See application file for complete search history.

(56) References Cited

U.S. PATENT DOCUMENTS 4,173,202 A 11/1979 Crise
5,163,386 A 11/1992 Schechter
6,202,623 B1 * 3/2001 Ehrlich ..... 123/197.4

FOREIGN PATENT DOCUMENTS

| | | | |
|---|---|---|---|
| EP | 1 143 127 | A | 10/2001 |
| EP | 1 201 894 | A | 5/2002 |
| JP | 62 041970 | A | 7/1987 |
| JP | 2001214770 | A | 8/2001 |
| JP | 2001289079 | A | 10/2001 |

* cited by examiner

*Primary Examiner*—Henry C. Yuen
*Assistant Examiner*—Hyder Ali
(74) *Attorney, Agent, or Firm*—Carrier, Blackman & Associates, P.C.; William D. Blackman; Joseph P. Carrier

(57) ABSTRACT

A variable compression ratio engine includes a control actuator which has a simple structure, seals well internally, and provides high reliability. In the variable compression ratio engine, a connecting rod is divided into at least two portions. A control rod is operatively connected to a juncture of the connecting rod. A support shaft position of the control rod is displaced. The control rod is operatively connected to a right cylinder rod of a piston-type double-acting hydraulic control cylinder. A piston section of the hydraulic control cylinder is configured to selectively move in accordance with displacement of the support shaft position of the control rod. A channel is used to connect two hydraulic chambers divided by the piston section. The channel is configured to selectively control the flow of hydraulic fluid from the right hydraulic chamber to the left hydraulic chamber, and vice versa.

15 Claims, 6 Drawing Sheets

ENGINE WITH VARIABLY ADJUSTABLE COMPRESSION RATIO, AND METHODS OF USING SAME

CROSS-REFERENCE TO RELATED APPLICATIONS

The present application claims priority under 35 U.S.C. 119 based on Japanese patent application 2003-193803, filed Jul. 8, 2003.

BACKGROUND OF THE INVENTION

1. Field of the Invention

The present invention relates to an engine having a variable compression ratio, and to methods of operating the engine. More particularly, the present invention relates to an engine in which the effective length of a connecting rod is made hydraulically adjustable to allow for adjustment of the compression ratio, and to methods of operating the described engine.

2. Background Art

Conventionally, it has been known that some vehicles such as cars may use a variable compression ratio engine, that provides an appropriate compression ratio according to driving conditions, by making an intermediate portion of a connecting rod flexibly adjustable. A flexing portion of the connecting rod needs to be movable while the engine is operating. Doing so requires a driving force of an actuator that exceeds the engine's inertia force, or an air-fuel mixture's explosion force acting on the flexing portion. Improving the control accuracy requires a large external energy or a complicated mechanism (see, e.g., Japanese published patent document JP-A 214770/2001).

By contrast, another technology is described in Japanese published patent document JP-A 289079/2001. This technology uses the engine's inertia force and the air-fuel mixture's explosion force acting on an operating piston as a differently directed force alternately acting on the flexing portion of the connecting rod. This force is used to operate a control mechanism connected to the connecting rod's flexing portion via a control rod. The control mechanism comprises two arced spaces that are separated by a moving vane, and are filled with hydraulic fluid. The hydraulic fluid is selectively ported from one space to the other, via a check valve, against the above-mentioned differently directed force This makes it possible to change or retain a flexing orientation of the connecting rod.

The technology described in Japanese published patent document JP-A 289079/2001 effectively uses the engine's inertia force and the air-fuel mixture's explosion force acting on the piston. There is an advantage of not requiring an extra power. However, the control mechanism is structured to be the two arced spaces that are separated by the moving vane. There are problems of complicating the structure and difficultly of ensuring sealability of the mechanism.

Although the known variable compression ratio engines are useful, a need still esists for an improved variable compression ratio engine that has a simple structure, ensures sealability, and provides high reliability.

SUMMARY OF THE INVENTION

To solve the above-mentioned problem, the present invention, according to a first aspect hereof, provides a variable compression ratio engine which divides a connecting rod into at least two portions, where the connecting rod converts vertical movement of a piston into rotary movement of a crankshaft. In the first aspect hereof, a control rod is operatively attached to a juncture of the connecting rod or to any one of a plurality of divided connecting rods. A support shaft position of the control rod may be displaced. The control rod is operatively connected to a cylinder rod of a piston-type, both rod type, double-acting hydraulic control cylinder. A piston section of the hydraulic control cylinder is configured to selectively move, in order to control displacement of a support shaft position of the control rod. According to another aspect hereof, a channel is used to connect two hydraulic chambers divided by the piston section, and the channel is configured to selectively control hydraulic fluid flow from the first hydraulic chamber to the second hydraulic chamber, and vice versa.

The novel construction allows the connecting rod to be bent at a controlled angle, as will be described subsequently herein.

A force is applied from the supporting position of the control rod to a cylinder rod attached to the piston of the hydraulic control cylinder. The hydraulic fluid flows through the channel from the first hydraulic chamber to the second hydraulic chamber, and vice versa. The piston section and the attached cylinder rod slide linearly, to change the flexing orientation of the connecting rod. The connecting rod orientation is held as follows. The channel is closed to prevent the hydraulic fluid from flowing through the hydraulic chambers. The piston section and the attached cylinder rod are prevented from sliding, to hold the flexing orientation of the connecting rod.

The reciprocating piston-type hydraulic control cylinder is used to simplify the structure, improve the accuracy of fixing the compression ratio, and to promote internal sealability.

A second aspect of the present invention is characterized in that part of the channel is provided with two branch channels which join downstream. The branch channels are provided with check valves having different directions; and a selector valve is used to choose between the branch channels.

This construction enables the following. When the selector valve selects one of the branch channels, one check valve allows movement of the hydraulic fluid from the first hydraulic chamber to the second hydraulic chamber in the hydraulic control cylinder. When the selector valve selects the other branch channel, the other check valve allows movement of the hydraulic fluid from the second hydraulic chamber to the first hydraulic chamber in the hydraulic control cylinder.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Selected illustrative embodiments of the present invention will be described herein, with reference to the accompanying drawings. It should be understood that herein, only structures considered necessary for clarifying the present invention are described. Other conventional structures, and those of ancillary and auxiliary components of the system, are assumed to be known and understood by those skilled in the art.

Figure 1:
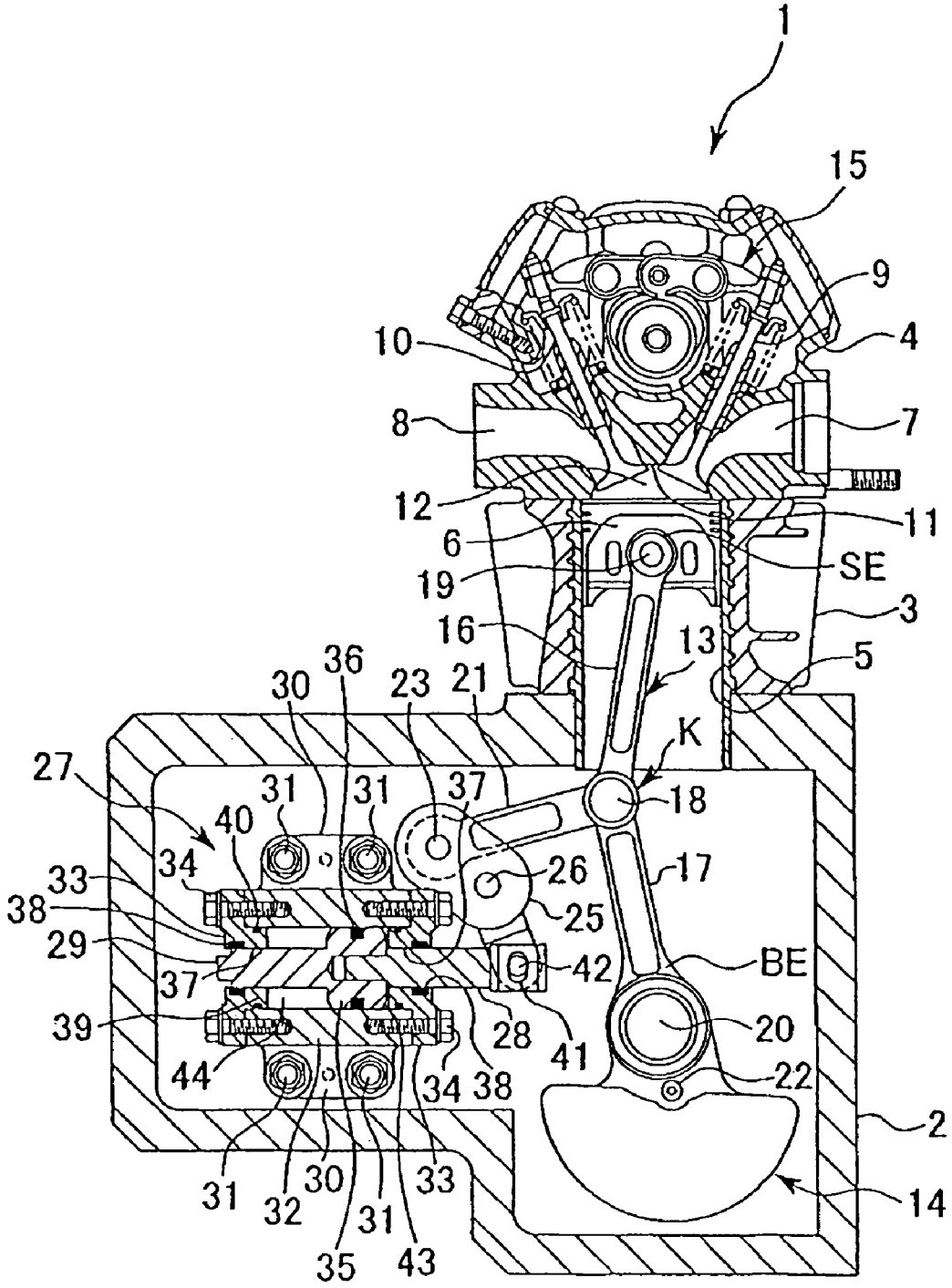
FIG. 1 is a sectional view of an engine according to a selected illustrative embodiment of the present invention.

Referring now to FIG. 1, an engine 1 according to a selected illustrative embodiment of the invention is shown in cross-section. The engine 1 is usable for vehicles such as motorcycles and all-terrain vehicles, and is provided with structure and controls enabling it to operate with a variably adjustable compression ratio, as will be further described herein.

The engine 1 includes a cylinder block 3, which is attached to a crankcase 2. The cylinder block 3 and crankcase 2 cooperate to define an engine block. A cylinder head 4 is mounted on top of the cylinder block 3. A cylinder 5 is defined as a hollow cylindrical bore formed in the cylinder block 3. A piston 6 is reciprocally movable in the cylinder 5, along a two-way path extending in a substantially vertical direction.

The cylinder head 4 is formed with an intake channel 7 and an exhaust channel 8 to provide respective flow paths for intake and exhaust air to travel to and from the cylinder 5. Each channel aperture is provided with its own respective valve, including an intake valve 9 to open and close the intake channel 7, and an exhaust valve 10 to open and close the exhaust channel 8.

A combustion chamber 12 is formed in the cylinder head 4 above an upper portion of the piston 6. The combustion chamber 12 is defined as the space between the piston 6, when it is positioned at top dead center, and a concave portion 11 of the cylinder head 4.

During operation of the engine 1, the piston 6 is pressed downwardly, due to an explosion force generated by the ignition of an air-fuel mixture in the combustion chamber 12. The air-fuel mixture is ignited by a spark plug (not shown) that pierces the cylinder head 4 and is provided with a tip end extending into the combustion chamber 12. The vertical reciprocating motion of the piston 6 in the cylinder 5 is converted, via the connecting rod 13, into rotary motion of a crankshaft 14. The rotary motion is transmitted, not only to a transmission (not shown), but also to a valve train 15 for operating the intake valve 9 and the exhaust valve 10.

According to the practice of the present invention, the connecting rod 13 is subdivided into an upper rod member 16 and a lower rod member 17. In the depicted embodiment, the bottom end of the upper rod member 16 is rotatably connected to a top end of the lower rod member 17 via a coupling pin 18, provided parallel to an axial direction of the crankshaft 14. The connecting rod 13 can flex in a dogleg shape at an intermediate portion thereof, designated as a flexing portion K. A small end SE of the connecting rod 13 is formed at the top end of the upper rod member 16, and is rotatably attached to the piston 6 via a piston pin 19. A big end BE of the connecting rod 13 is formed at the bottom end of the lower rod member 17, and is rotatably attached to a crankpin 20. Reference numeral 22 indicates the rotary center of the crankshaft 14.

A control rod 21 is connected, via the coupling pin 18, to the flexing portion K of the connecting rod 13, so as to adjust a flexing degree of the connecting rod 13. The control rod 21 is an almost horizontally extending bar-shaped member. The compression ratio of the engine is able to be variably adjusted by moving the control rod 21 to vary the position of the coupling pin 18, thereby adjusting the effective length of the connecting rod 13. A base of the control rod 21 is axially supported by a pin 23 which is provided parallel to the crankshaft 14 at one end of a lever arm 25, to be discussed in more detail below. The tip of the control rod 21 is joined to the connecting rod 13 via the coupling pin 18, and is rotatably and axially supported by the juncture formed between the bottom end of the upper rod member 16 and the top end of the lower rod member 17. As previously noted, the coupling pin 18 also connects the bottom end of the upper rod member 16 and the top end of the lower rod member 17 together. Accordingly, the control rod 21 regulates a locus of the flexing portion K for the connecting rod 13.

The pin 23 is provided at one end of the lever arm 25 supported by the crankcase 2, and regulates the oscillation center of the control rod 21. The lever arm 25 is a bent member formed in a dogleg shape. The lever arm 25 is rotatably supported in the crankcase 2 via a support shaft 26, located approximately at the center of the lever arm 25, and provided parallel to the crankshaft 14. The support shaft 26 is substantially fixed in place in relation to the crankcase 2.

The upper end of the lever arm 25 is provided with the pin 23 that axially supports the base of the control rod 21. The lower end of the lever arm 25 is operatively connected to an end of a right cylinder rod 28 of a hydraulic control cylinder 27.

When a piston section 35 of the hydraulic control cylinder 27 to be described is positioned to the neutral, the lever arm 25 is supported in the crankcase 2 so that a portion below the support shaft 26 moves almost downward. This provides almost the same horizontal pivot angle as that generated when the portion below the support shaft 26 of the lever arm 25 moves horizontally.

The hydraulic control cylinder 27 is fixed, via a bracket 30, to the crankcase 2 with a series of bolts 31. The hydraulic control cylinder 27 is a piston-type, dual rod type, and double-acting hydraulic control cylinder. End caps 33 are fixed with bolts 34 at both ends of a cylindrical casing 32. Inside the casing 32, a piston section 35 is movably provided so as to slide along an inside surface of a cylindrical bore 52 formed inside of the casing 32. Both ends of the piston section 35 are provided with respective cylinder rods extending outwardly therefrom, including a right cylinder rod 28 and a left cylinder rod 29 protruding from the corresponding end caps 33. The piston section 35 and the left cylinder rod 29 are molded integrally.

An outside periphery of the piston section 35 is provided with a seal 36 so as to be sealed against an inside peripheral surface of the bore 52 formed inside of the casing 32. Insertion holes 37 are provided for the cylinder rods 28 and 29 corresponding to the end caps 33. Inside peripheries of the insertion holes 37 are provided with seals 38 for sealing between the right cylinder rod 28 and the left cylinder rod 29. Each end cap 33 has a boss 39 protruding into the casing 32. An outside peripheral surface of the boss 39 is provided with a seal 40 in close contact with the inside peripheral surface of the bore 52 formed in the casing 32.

A vertical slot 41 is formed in a tip of the right cylinder rod 28. A pin 42 is provided at the lower end of the lever arm 25, and is inserted into the vertical slot 41. The tips of the lever arm 25 and the right cylinder rod 28 are rotatably supported so as to enable free vertical movement of the pin 42 in the vertical slot. When the bottom end of the lever arm 25 pivots around the support shaft 26, provision of the vertical slot 41 enables the pin 42 to allow a displacement below the shaft center of the right cylinder rod 28 in the hydraulic control cylinder 27.

Figure 2:
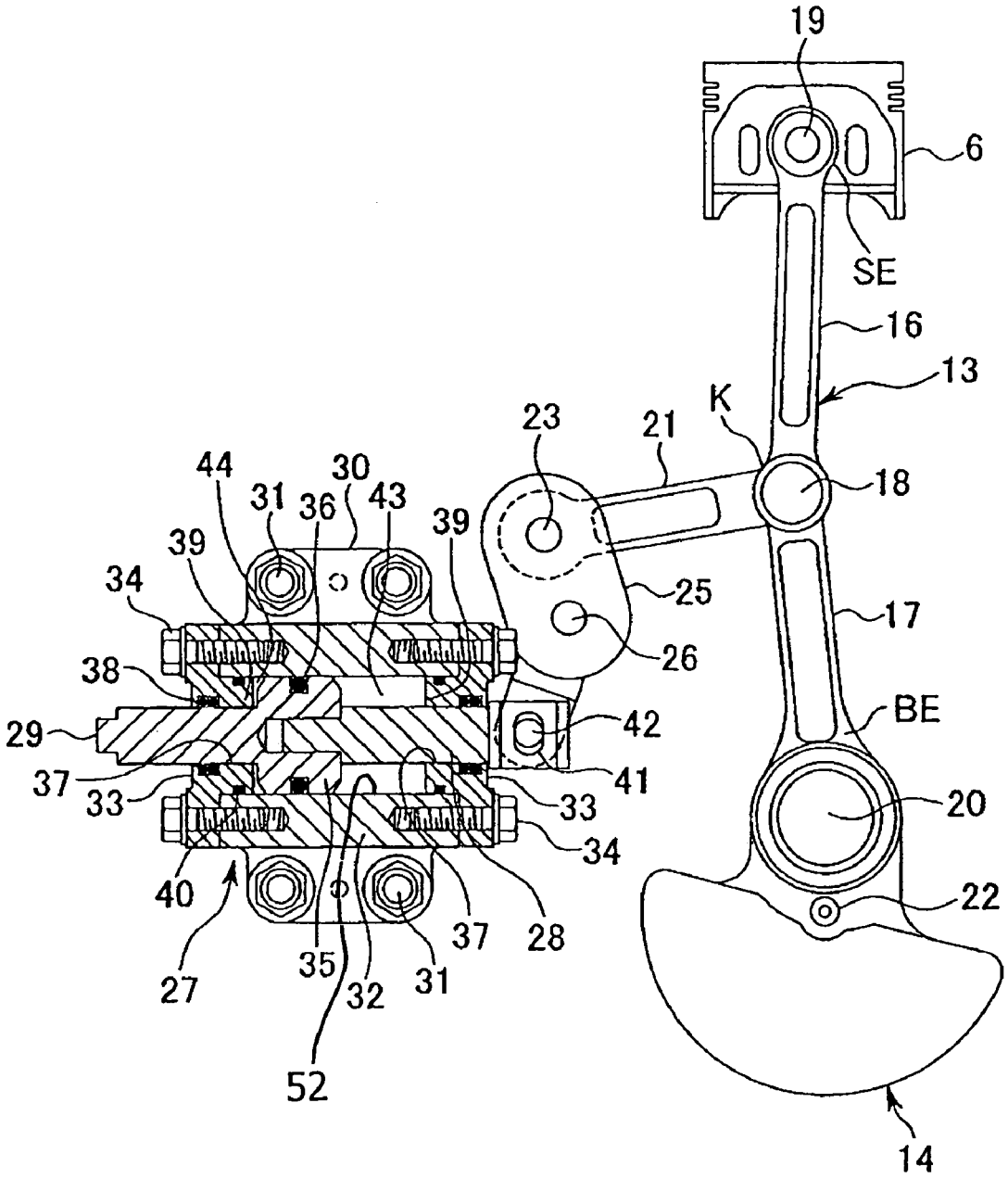
FIG. 2 is a sectional detail view of part of the engine of FIG. 1, showing a position for a high compression ratio according to the selected embodiment of the present invention.

As shown in FIG. 2, let us assume that the piston section 35 in the hydraulic control cylinder 27 is positioned at the left end of the casing 32. In this case, the lever arm 25 pivots around the support shaft 26, via the right cylinder rod 28, moving the upper end thereof to the right as shown in the drawing. The control rod 21 accordingly moves to the right end of its travel range. This causes a small angle formed by the upper rod member 16 and the lower rod member 17 so that the flexing portion K approximates to be more straight. This also causes the longest distance between the piston pin 19 and the crankpin 20 for the connecting rod 13, comprising the upper rod member 16 and the lower rod member 17. As a result, the piston will travel to its highest level in the cylinder block 3, and a compression ratio of the engine 1 becomes maximum. In this case, the compression ratio is found by adding a stroke volume to a combustion chamber volume and then dividing a result by the combustion chamber volume.

Figure 3:
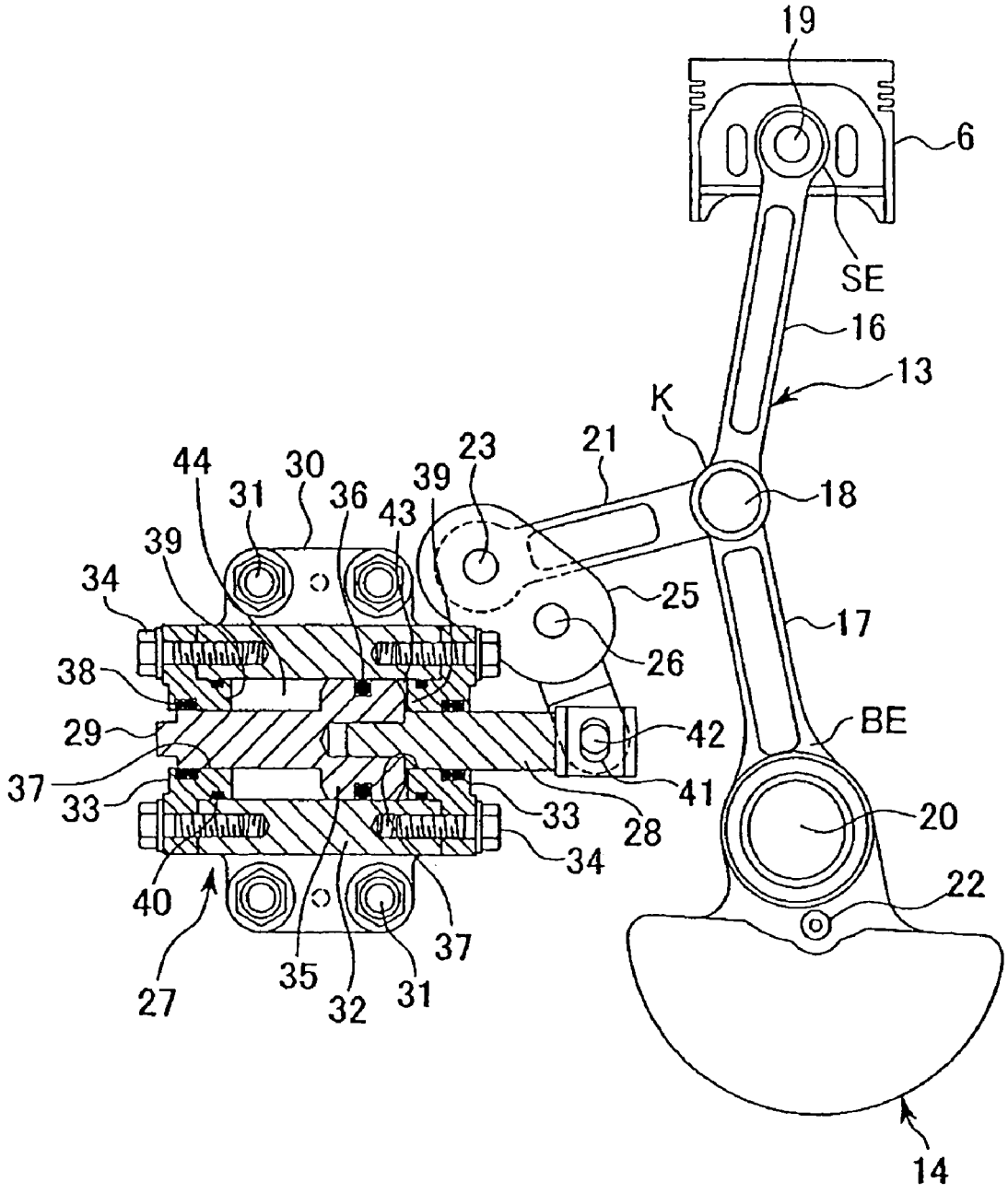
FIG. 3 is a sectional detail view of part of the engine of FIG. 1, showing a position for a low compression ratio according to the selected embodiment of the present invention.

On the other hand, as shown in FIG. 3, let us assume that the piston section 35 in the hydraulic control cylinder 27 is positioned at the right end of the casing 32. In this case, the lever arm 25 rotates around the support shaft 26 via the right cylinder rod 28, moving the upper end thereof to the left. The control rod 21, accordingly, moves to the left end of its range of travel. This causes a larger angle formed by the upper rod member 16 and the lower rod member 17 so that the flexing portion K bends more remarkably. This also causes the shortest distance between the piston pin 19 and the crankpin 20 for the connecting rod 13 comprising the upper rod member 16 and the lower rod member 17. As a result, the height of the piston at the top of its travel is reduced, and the compression ratio of the engine 1 becomes minimum.

Figure 4:
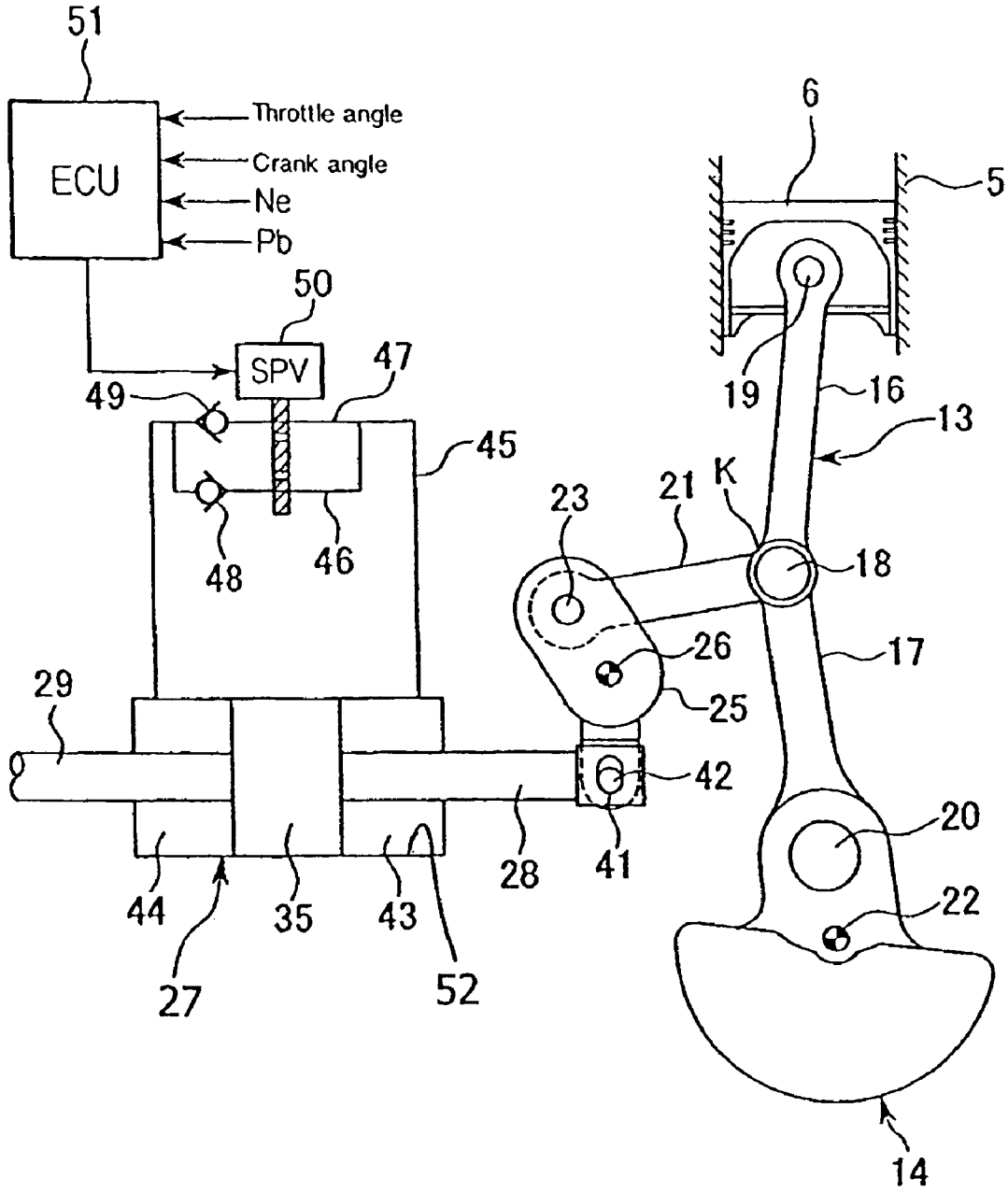
FIG. 4 is a system diagram for the embodiment of the present invention.

As shown in FIG. 4, the piston section 35 divides a hydraulic chamber, defined within the bore 52 of the casing 32, into right and left chambers 43, 44, respectively. In the casing 32, a right hydraulic chamber 43 is formed surrounding the right cylinder rod 28, to the right side of the piston section 35. A left hydraulic chamber 44 is formed surrounding the left cylinder rod 29, to the left side of the piston section 35. The right hydraulic chamber 43 is connected to the left hydraulic chamber 44 via a channel 45.

Part of the channel 45 is provided with two branch channels 46 and 47 that join downstream. The branch channels 46 and 47 are respectively provided with check valves 48 and 49, having different flow directions. The check valve 48 permits flow of the hydraulic fluid from the right hydraulic chamber 43 to the left hydraulic chamber 44. The check valve 49 permits flow of the hydraulic fluid from the left hydraulic chamber 44 to the right hydraulic chamber 43.

A selector valve 50 operates under control of an Electronic Control Unit (ECU) 51. Operating the selector valve 50 selects one of the branch channels 46 and 47, and closes the other (FIGS. 5 and 6) or closes both (FIG. 4). The ECU 51 is omitted from FIGS. 5 and 6.

Figure 5:
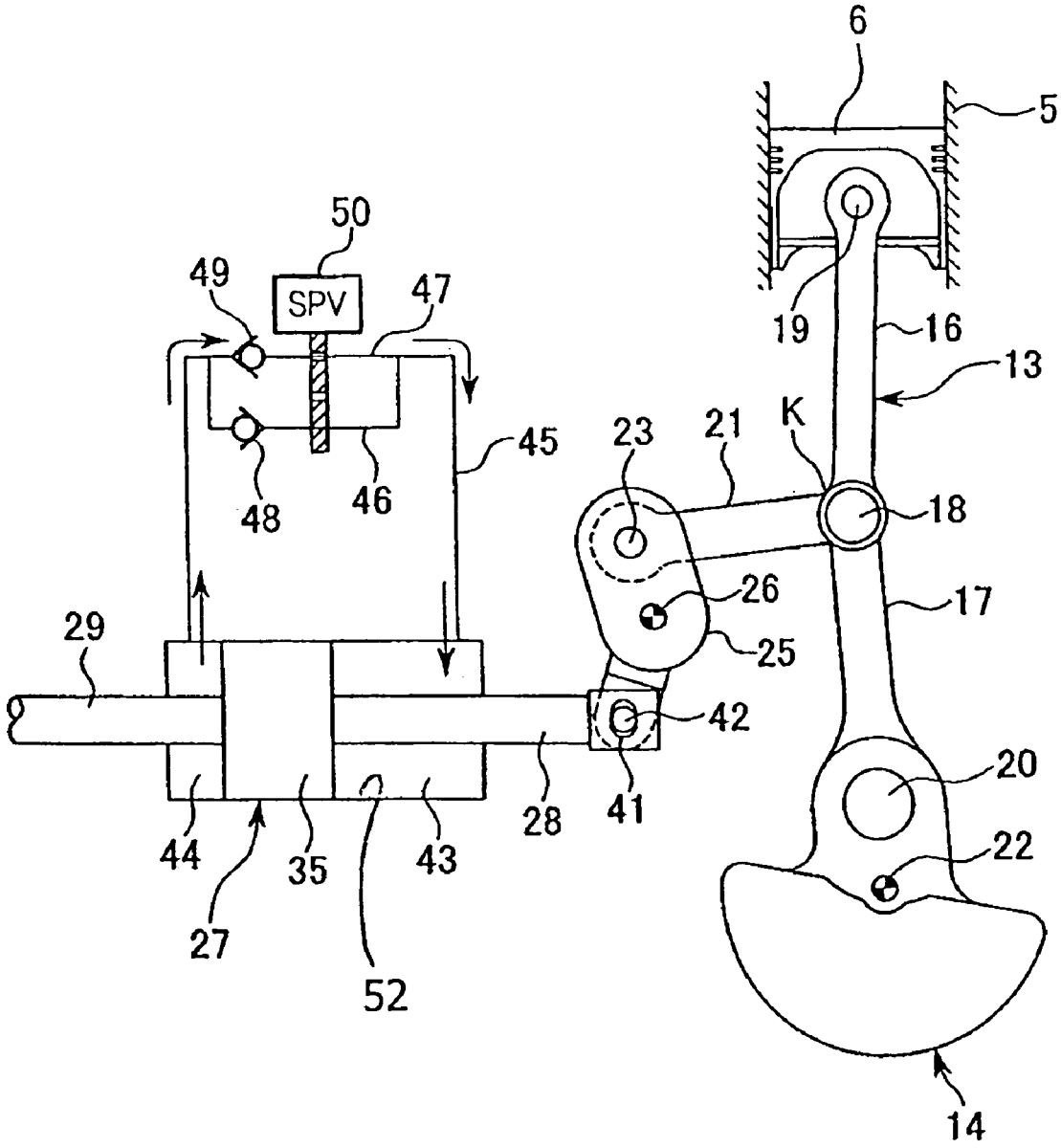
FIG. 5 is a partial system diagram for the embodiment of the present invention positioned to a high compression ratio.
Figure 6:
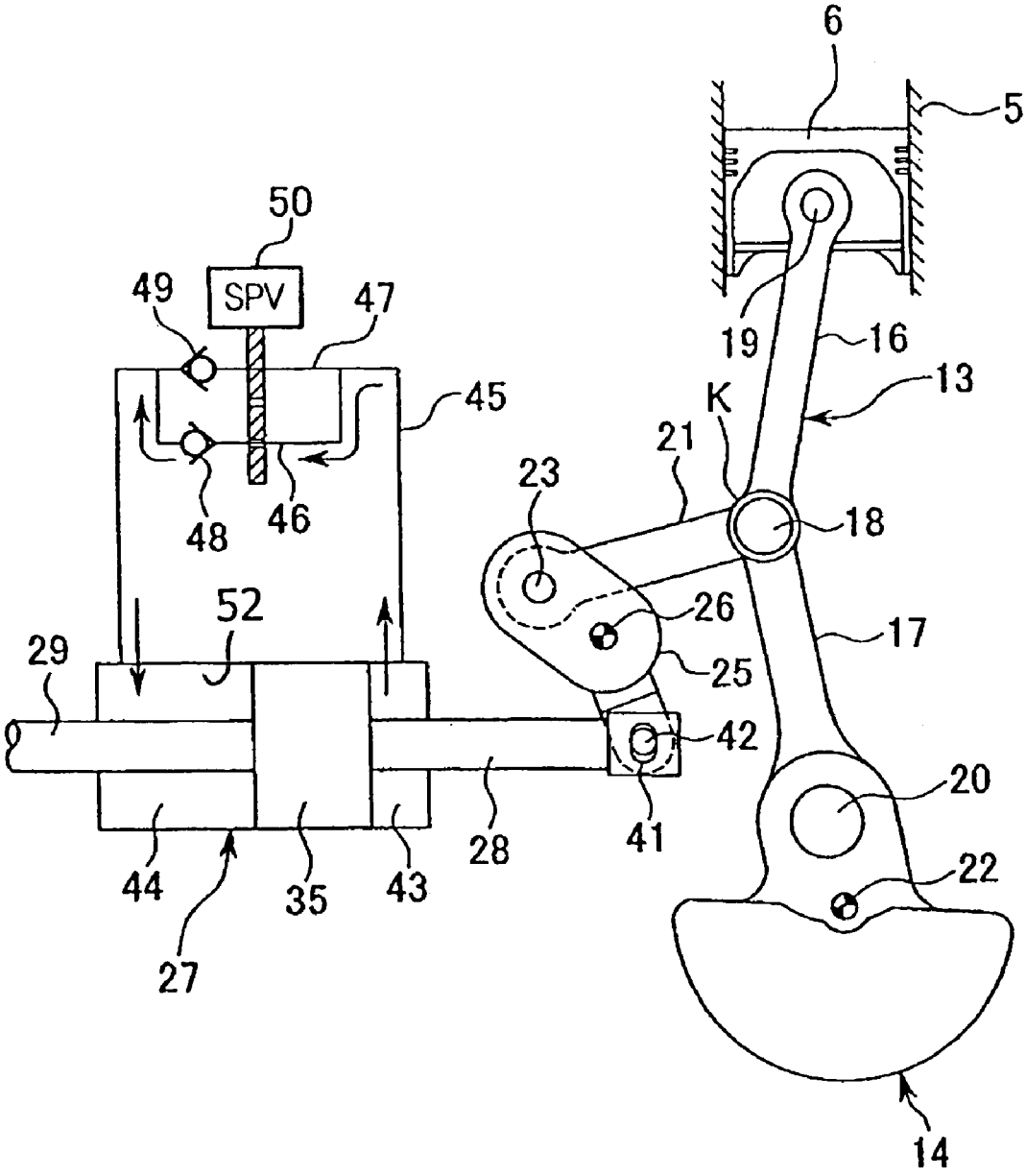
FIG. 6 is a partial system diagram for the embodiment of the present invention positioned to a low compression ratio.

More specifically, FIG. 5 shows that the selector valve 50 closes the branch channel 46 and selects the branch channel 47. This enables a position for the high compression ratio. In this case, the hydraulic fluid is allowed to move in the channel from the left hydraulic chamber 44 to the right hydraulic chamber 43 via the branch channel 47. FIG. 6 shows that the selector valve 50 closes the branch channel 47 and selects the branch channel 46. This enables a position for the low compression ratio. In this case, the hydraulic fluid is allowed to move in the channel from the right hydraulic chamber 43 to the left hydraulic chamber 44 via the branch channel 46. FIG. 4 shows that the selector valve 50 closes both the branch channels 46 and 47 (hold position). The hydraulic fluid is prevented from moving between the left hydraulic chamber 44 and the right hydraulic chamber 43, locking the hydraulic control cylinder 27. While there has been described in FIG. 4 that the piston section 35 is held at the center of the casing 32, it is to be distinctly understood that the piston section 35 can be held at any position.

The selector valve 50 is operated based on a signal from the ECU 51. For this purpose, the ECU 51 is supplied with sensor signals for crank angles, engine speeds (Ne), intake manifold pressures (Pb), throttle angles, and the like.

According to the above-mentioned embodiment, the engine 1 may need to change to the high compression ratio based on sensor signals for the crank angle, the engine speed, the intake manifold pressure, and the throttle angle supplied to the ECU 51. In such case, the ECU 51 sends a signal to change the selector valve 50 to the high compression ratio position in FIG. 5 and select the branch channel 47. A vertical movement of the piston 6 applies a load on the lever arm 25 from the flexing portion K of the connecting rod 13 via the control rod 21. A load is applied to the lever arm 25 to rotate it counterclockwise in vain, because the check valve 49 prevents movement of the hydraulic fluid from the right hydraulic chamber 43 to the left hydraulic chamber 44.

Let us assume that a load is applied to rotate the lever arm 25 clockwise. The check valve 49 permits movement of the hydraulic fluid from the left hydraulic chamber 44 to the right hydraulic chamber 43. Consequently, the piston section 35 of the hydraulic control cylinder 27 moves to the left by pushing the hydraulic fluid out of the left hydraulic chamber 44 to the right hydraulic chamber 43. This allows clockwise rotation of the lever arm 25. The connecting rod 13 changes its orientation to the high compression ratio side as shown in FIG. 5. Then, setting the selector valve 50 to the hold position allows the connecting rod 13 to maintain the orientation for the high compression ratio.

The engine may need to be changed to the low compression ratio. In such case, the ECU 51 outputs a signal to change the selector valve 50 to the low compression ratio position in FIG. 6 and select the branch channel 46. A vertical movement of the piston 6 applies a load on the lever arm 25 from the flexing portion K of the connecting rod 13 via the control rod 21. A load is applied to the lever arm 25 to rotate it clockwise in vain because the check valve 49 prevents movement of the hydraulic fluid from the left hydraulic chamber 44 to the right hydraulic chamber 43.

Let us assume that a load is applied to rotate the lever arm 25 counterclockwise. The check valve 48 permits movement of the hydraulic fluid from the right hydraulic chamber 43 to the left hydraulic chamber 44. Consequently, the piston section 35 of the hydraulic control cylinder 27 moves to the right by pushing the hydraulic fluid out of the right hydraulic chamber 43 to the left hydraulic chamber 44. This allows counterclockwise rotation of the lever arm 25. The connecting rod 13 changes its orientation to the low compression ratio side as shown in FIG. 6. Then, setting the selector valve 50 to the hold position allows the connecting rod 13 to maintain the orientation for the low compression ratio.

When a desired compression ratio is obtained, setting the selector valve 50 to the hold position can hold the piston section 35 at that position. The engine 1 can operate at an optimum compression ratio.

As a result, it is possible to efficiently use a driving force of the engine 1 acting on the lever arm 25. The hydraulic fluid moves through the branch channel 46 or 47 selected by the selector valve 50 with the flowing direction restricted by the check valve 48 or the check valve 49. This makes it possible to move the hydraulic control cylinder 27 in a specified direction. The connecting rod 13 can be maintained between the high compression ratio and the low compression ratio without applying an extra power.

The reciprocating piston-type hydraulic control cylinder 27 is used to simplify the structure, improve the accuracy of fixing the compression ratio, and to ensure sealability for the seals 36 and 38. It is possible to provide high durability and reliability after long-term use.

That is to say, the seal 36 just needs to ensure sealability during simple reciprocating slides of the piston section 35. The seal 38 just needs to ensure sealability during simple reciprocating slides of the right cylinder rod 28 and the left cylinder rod 29. These are advantageous to ensuring sealability.

The present invention is not limited to the above-mentioned embodiment. For example, the present invention can be applied to not only motorcycle engines, but also vehicle engines in general. There has been described the case where the control rod 21 is operatively connected to the coupling pin 18, i.e., a junction between the upper rod member 16 and the lower rod member 17. Further, the control rod 21 may be operatively connected to the upper rod member 16 and the lower rod member 17 near the coupling pin 18.

[Effects of the Invention]

As mentioned above, the first aspect of the present invention allows the connecting rod to be bent as follows. A force is applied from the supporting position of the control rod to one of both cylinder rods attached to the piston of the hydraulic control cylinder. The hydraulic fluid flows through the channel from the the first hydraulic chamber to the second hydraulic chamber, and vice versa. The piston, i.e., the cylinder rod linearly slides to change the flexing orientation of the connecting rod. The connecting rod orientation is held as follows. The channel is closed to prevent the hydraulic fluid from flowing through the hydraulic chambers. The piston, i.e., the cylinder rod is prevented from sliding to hold the flexing orientation of the connecting rod. There is an effect of operating the engine at an optimum compression ratio by efficiently using the engine's inertia force and the air-fuel mixture's explosion force.

Especially, the reciprocating piston-type hydraulic control cylinder is used to simplify the structure, improve the accuracy of fixing the compression ratio, and easily ensuring sealability. It is possible to provide high durability and reliability after long-term use.

The second aspect of the present invention enables the following. When the selector valve selects one of the branch channels, one check valve allows movement of the hydraulic fluid from the first hydraulic chamber to the second hydraulic chamber in the hydraulic control cylinder. When the selector valve selects the other branch channel, the other check valve allows movement of the hydraulic fluid from the other check valve to the first hydraulic chamber in the hydraulic control cylinder. It is possible to easily ensure sealability and improve the accuracy of fixing the compression ratio even for the simple construction using the reciprocating piston-type hydraulic control cylinder. There is an effect of providing high reliability.

Although the present invention has been described herein with respect to a number of specific illustrative embodiments, the foregoing description is intended to illustrate, rather than to limit the invention. Those skilled in the art will realize that many modifications of the preferred embodiment could be made which would be operable. All such modifications, which are within the scope of the claims, are intended to be within the scope and spirit of the present invention.

What is claimed is:

1. A variable compression ratio engine, comprising:

an engine block having at least one cylinder formed therein;

a piston disposed in said cylinder for reciprocal movement therein;

a crankshaft rotatably disposed in said engine block;

a connecting rod operatively attached to said crankshaft and to said piston for converting reciprocal movement of said piston in said cylinder into rotary movement of said crankshaft, said connecting rod formed in at least two portions which are joined at a juncture;

a control rod operatively connected to said connecting rod proximate said juncture thereof, a piston-type double-acting hydraulic cylinder disposed in said engine block;

wherein said control rod is operatively connected to a cylinder rod of said hydraulic cylinder in a manner such that said cylinder rod is operable to displace a support shaft position of said control rod;

wherein a piston section of said hydraulic cylinder is configured to selectively move in accordance with displacement of the support shaft position of said control rod;

wherein a channel is used to connect two hydraulic chambers of said hydraulic cylinder divided by said piston section; and wherein said channel is configured to selectively control fluid flow between said hydraulic chambers.

2. The variable compression ratio engine of claim 1, wherein part of said channel is provided with two branch channels which join downstream;

wherein said branch channels are provided with check valves having different flow directions; and wherein a selector valve is used to choose from said branch channels.

3. The engine of claim 1, further comprising a support shaft fixed in place in the engine block, and a lever arm which is pivotally mounted on the support shaft, wherein one end of the lever arm is connected to said control rod, and another end of said lever arm is connected to said cylinder rod.

4. The engine of claim 1, wherein the juncture of the connecting rod comprises a coupling pin which pivotally joins the two portions of the connecting rod together.

5. The engine of claim 3, wherein the juncture of the connecting rod comprises a coupling pin which pivotally joins the two portions of the connecting rod together.

6. The engine of claim 5, wherein the control rod is pivotally connected to the connecting rod by said coupling pin.

7. A variable compression ratio engine, comprising:

an engine block having at least one cylinder formed therein;

a crankshaft rotatably disposed in said engine block;

a connecting rod operatively attached to said crankshaft for converting vertical movement of a piston in said cylinder into rotary movement of said crankshaft, said connecting rod being formed in at least two portions connected at a juncture;

a control rod having a first end which is operatively connected to said connecting rod proximate said juncture;

a hydraulic cylinder disposed in said engine block, said hydraulic cylinder comprising a sleeve, a piston section slidably disposed in said sleeve, and a cylinder rod connected to said piston section for concurrent movement therewith;

wherein said control rod has a second end which is operatively connected to the cylinder rod of said hydraulic cylinder;

wherein the piston section of said hydraulic cylinder is configured to selectively move in accordance with displacement of the second end of said control rod;

wherein a channel is used to connect two hydraulic chambers divided by said piston section; and wherein said channel is configured to selectively control fluid flow between said hydraulic chambers.

8. The variable compression ratio engine of claim 7, wherein part of said channel is provided with two branch channels which join downstream;

wherein said branch channels are provided with check valves having different flow directions; and wherein a selector valve is used to choose from said branch channels.

9. The engine of claim 7, further comprising a support shaft fixed in place in the engine block, and a lever arm which is pivotally mounted on the support shaft, wherein one end of the lever arm is connected to said control rod, and another end of said lever arm is connected to said cylinder rod.

10. The engine of claim 7, wherein the juncture of the connecting rod comprises a coupling pin which pivotally joins the two portions of the connecting rod together.

11. The engine of claim 9, wherein the juncture of the connecting rod comprises a coupling pin which pivotally joins the two portions of the connecting rod together.

12. The engine of claim 11, wherein the control rod is pivotally connected to the connecting rod by said coupling pin.

13. A method of controlling the compression ratio of an internal combustion engine, the engine comprising:

an engine block having at least one cylinder formed therein;

a piston disposed in said cylinder for reciprocal movement therein;

a crankshaft rotatably disposed in said engine block;

a connecting rod operatively attached to said crankshaft and to said piston for converting reciprocal movement of said piston in said cylinder into rotary movement of said crankshaft, said connecting rod formed in at least two portions which are joined at a juncture;

a control rod operatively connected to said connecting rod proximate said juncture thereof, a piston-type double-acting hydraulic control cylinder disposed in said engine block;

wherein said control rod is operatively connected to a cylinder rod of said hydraulic control cylinder in a manner such that said cylinder rod is operable to displace a support shaft position of said control rod;

wherein a piston section of said hydraulic control cylinder is configured to selectively move in accordance with displacement of the support shaft position of said control rod;

wherein a channel is used to connect two hydraulic chambers of said hydraulic control cylinder divided by said piston section; and wherein said channel is configured to selectively control fluid flow between said hydraulic chambers, said method comprising the steps of:

a) monitoring a plurality of sensor signals with an electronic control unit;

b) analyzing said sensor signals at a selected time and determining a target connecting rod length; and adjusting the effective length of said adjustable connecting rod by moving a piston section of a hydraulic control cylinder which is operatively connected to said connecting rod.

14. The method of claim 13, further comprising a step of:

c) repeating steps a–c after a preset time period has elapsed.

15. The method of claim 14, wherein the monitored sensor signals include at least one of crank angle, engine speed, intake manifold pressure, and throttle angle.

* * * * *